US008162359B2

(12) United States Patent
Haruyama

(10) Patent No.: US 8,162,359 B2
(45) Date of Patent: Apr. 24, 2012

(54) PUSHBUTTON MECHANISM AND IMAGE FORMING APPARATUS

(75) Inventor: Masahiro Haruyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 589 days.

(21) Appl. No.: 12/314,873

(22) Filed: Dec. 18, 2008

(65) Prior Publication Data

US 2009/0169295 A1 Jul. 2, 2009

(30) Foreign Application Priority Data

Dec. 27, 2007 (JP) ..... 2007-336034

(51) Int. Cl.
*E05C 3/06* (2006.01)
*E05C 3/16* (2006.01)

(52) U.S. Cl. ..... 292/216; 292/194; 292/DIG. 31; 292/DIG. 37

(58) Field of Classification Search ..... 292/216, 292/DIG. 31, DIG. 37, 194; 200/339
See application file for complete search history.

(56) References Cited

U.S. PATENT DOCUMENTS 274,497 A * 3/1883 Judson ..... 292/121
1,556,524 A * 10/1925 Kibble et al. ..... 292/127
2,086,034 A * 7/1937 Jacobi ..... 70/144
2,233,699 A * 3/1941 Gorrell ..... 292/227
2,313,712 A * 3/1943 Jacobi ..... 70/451
2,337,894 A * 12/1943 Jacobi ..... 292/227
2,399,812 A * 5/1946 Ledin ..... 70/84
2,494,048 A * 1/1950 Ledin ..... 292/227
4,208,837 A * 6/1980 Black et al. ..... 49/56
4,677,715 A * 7/1987 Escaravage ..... 24/637
5,044,810 A * 9/1991 Matsuoka et al. ..... 403/93
5,158,329 A * 10/1992 Schlack ..... 292/87
5,321,962 A * 6/1994 Ferchau et al. ..... 70/208
5,785,398 A * 7/1998 Park ..... 312/223.2
5,823,644 A * 10/1998 Suh et al. ..... 312/223.2
5,833,048 A * 11/1998 Dilly ..... 200/446
5,850,062 A * 12/1998 Botz et al. ..... 200/315
6,637,847 B2 * 10/2003 Crisp et al. ..... 312/223.2
7,441,813 B2 * 10/2008 Qin et al. ..... 292/163
7,521,642 B2 * 4/2009 Belanger ..... 200/339
7,806,446 B2 * 10/2010 Oh ..... 292/165

FOREIGN PATENT DOCUMENTS

JP 58-176239 U 11/1983
JP 62-133341 U 8/1987
JP 2005-001797 1/2005
JP 2007-230157 9/2007

* cited by examiner

*Primary Examiner* — Carlos Lugo
(74) *Attorney, Agent, or Firm* — Kubotera & Associates, LLC

(57) ABSTRACT

A pushbutton mechanism includes a case member having an operation surface with a button hole and a pushbutton having an upper surface to be pushed inside the case member in a pushing direction. The upper surface includes a first portion at a front side of the operation surface and a second portion at a rear side of the operation surface. The first portion is formed in a first shape, and the second portion is formed in a second shape different from the first shape along the pushing direction.

11 Claims, 9 Drawing Sheets

PUSHBUTTON MECHANISM AND IMAGE FORMING APPARATUS

BACKGROUND OF THE INVENTION AND RELATED ART STATEMENT

The present invention relates to a pushbutton mechanism provided in an image forming apparatus such as a copier, a printer, a facsimile, and the likes, and relates to an image forming apparatus having the pushbutton mechanism.

In a conventional image forming apparatus, after a print medium is discharged, the print medium is accumulated on a top cover, thereby reducing a size of the conventional image forming apparatus. In this case, the top cover is disposed to be rotatable. When a trouble such as a print medium jam occurs during a printing operation, or a consumable component is replaced, the top cover is opened by an angle greater than 90 degrees, thereby making it easy to access inside the conventional image forming apparatus.

In the conventional image forming apparatus, an operator pushes a pushbutton situated on a front portion of the conventional image forming apparatus for opening the top cover, so that the operator removes the print medium jam or replace the consumable component (refer to Patent Reference).

Patent Reference: Japanese Patent Publication No. 2005-1797

In a conventional pushbutton mechanism of the conventional image forming apparatus, when the operator pushes the pushbutton, a nail of the operator may be caught with an edge of a pushbutton hole formed in a case member or a housing.

In view of the problems described above, an object of the present invention is to provide a pushbutton mechanism and an image forming apparatus capable of solving the problems of the conventional pushbutton mechanism. In the pushbutton mechanism of the present invention, it is possible to prevent a nail of an operator from being caught with an edge of a pushbutton hole formed in a case member or a housing of the image forming apparatus.

Further objects and advantages of the invention will be apparent from the following description of the invention.

SUMMARY OF THE INVENTION

In order to attain the objects described above, according to the present invention, a pushbutton mechanism includes a case member having an operation surface with a button hole and a pushbutton having an upper surface to be pushed inside the case member in a pushing direction. The upper surface includes a first portion at a front side of the operation surface and a second portion at a rear side of the operation surface. The first portion is formed in a first shape, and the second portion is formed in a second shape different from the first shape along the pushing direction.

In the present invention, the upper surface of the pushbutton includes the first portion at the front side of the operation surface and the second portion at the rear side of the operation surface. The first portion is formed in the first shape different from the second shape of the second portion. Accordingly, the operator is able to push the pushbutton with high attention. More specifically, the operator can attentively place a finger on the first portion at the front side with respect to the operator. Accordingly, it is possible to prevent a nail of the operator from being caught with an edge of a pushbutton hole formed in a case member or a housing of an image forming apparatus.

According to the present invention, when the second portion is formed in a protruded shape, it is possible to more efficiently prevent the nail of the operator from being caught with the edge of the pushbutton hole when the operator pushes the pushbutton.

DETAILED DESCRIPTION OF PREFERRED EMBODIMENTS

Hereunder, embodiments of the present invention will be explained with reference to the accompanying drawings.

First Embodiment

Figure 2:
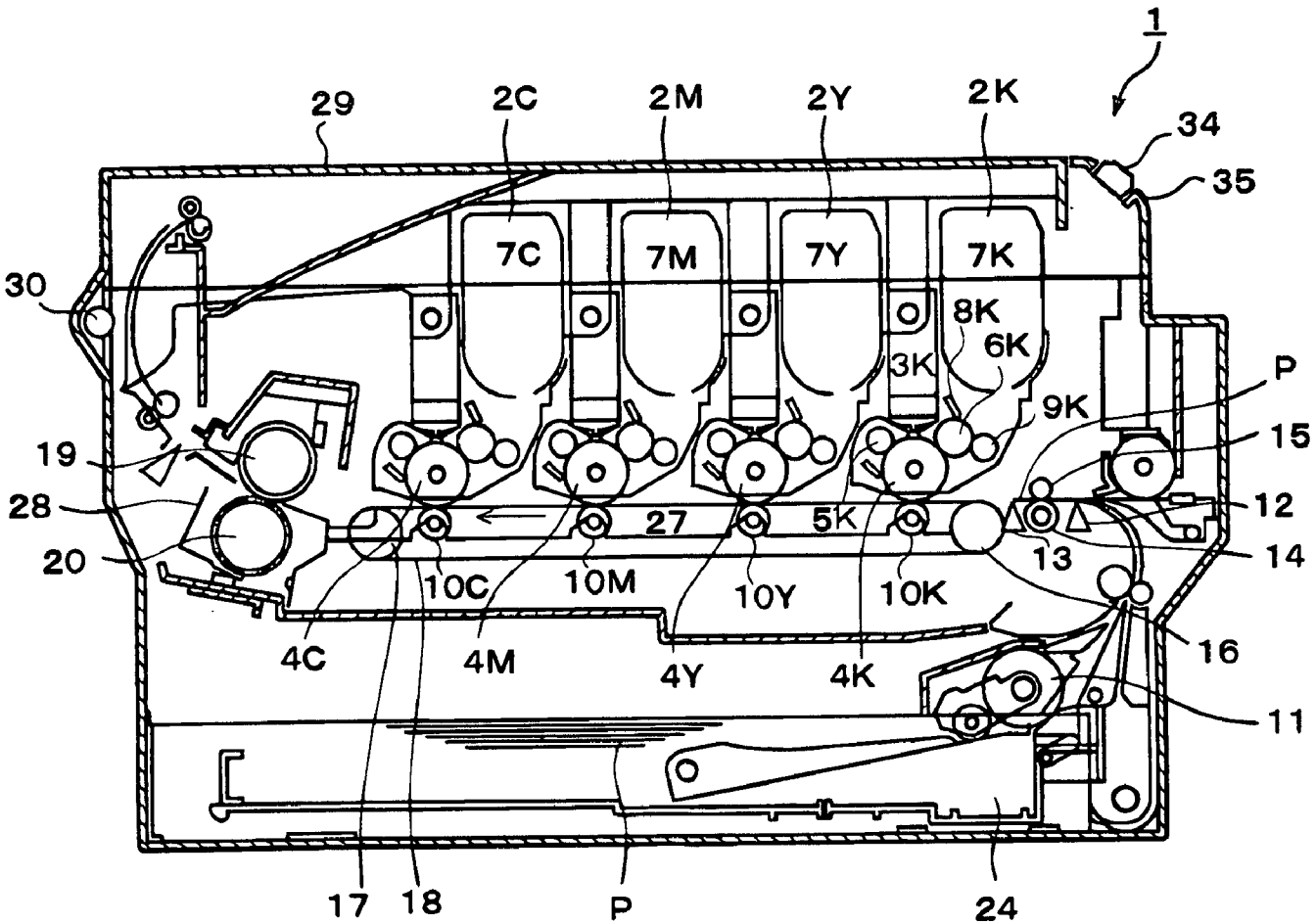
FIG. 2 is a schematic view showing an image forming apparatus according to the first embodiment of the present invention.

A first embodiment of the present invention will be explained. FIG. 2 is a schematic view showing an image forming apparatus 1 according to the first embodiment of the present invention.

As shown in FIG. 2, the image forming apparatus 1 includes image forming units 2K, 2Y, 2M, and 2C; corresponding transfer rollers 10K, 10Y, 10M, and 10C; and a transfer unit 27 formed of a transport belt 18 with an endless shape for transporting a medium, a belt follower roller 16, and a belt drive roller 17.

In the embodiment, the image forming apparatus 1 further includes a sheet cassette 24 for storing a plurality of sheets so that the sheets are sequentially picked up therefrom; a sheet supply roller 11 for separating and picking up the sheet one by one from the sheet cassette 24 together with a separation tongue; a writing sensor 13; transport rollers 14 and 15; and a fixing unit 28. The fixing unit 28 includes a fixing roller 19 with a heating member such as a halogen lamp disposed therein for heating and pressing the sheet, and a fixing backup roller 20.

In the embodiment, the image forming units 2K, 2Y, 2M, and 2C are provided for printing images in black, yellow, magenta, and cyan. The image forming units 2K, 2Y, 2M, and 2C have a similar configuration. For example, the image forming unit 2K includes an LED (Light Emitting Diode) head 3K; a photosensitive drum 4K; a charging roller 5K; a developing roller 6K; a toner tank 7K; a developing blade 8K; and a toner supply sponge 9K.

In the embodiment, the image forming apparatus 1 further includes a top cover 29. The top cover 29 is disposed to be rotatable around a shaft 30 or a pivot. When the top cover 29 rotates and opens, it is possible to attach or detach the image forming units 2K, 2Y, 2M, and 2C; the transfer unit 27; or the fixing unit 28. Further, the image forming apparatus 1 includes a front case 35, and a pushbutton 34 for opening and closing the top cover 29 (described later).

Figure 3:
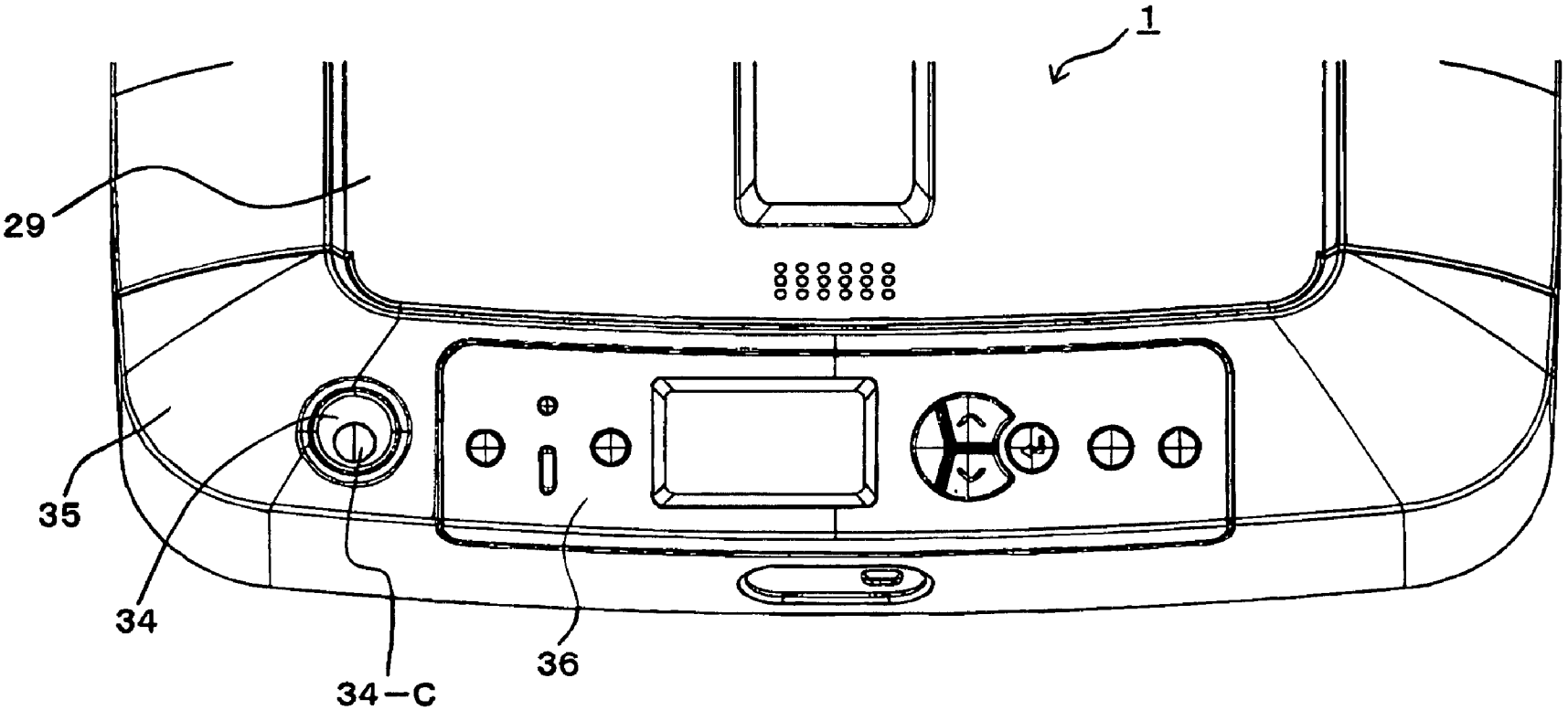
FIG. 3 is a schematic plan view showing an operation panel of the image forming apparatus according to the first embodiment of the present invention.

FIG. 3 is a schematic plan view showing an operation panel 36 of the image forming apparatus 1 according to the first embodiment of the present invention.

As shown in FIG. 3, the top cover 29 is situated at an upper portion of the front case 35 of the image forming apparatus 1. Further, the operation panel 36 is provided for setting various functions of the image forming apparatus 1. The pushbutton 34 is disposed adjacent to the operation panel 36 for opening and closing the top cover 29.

Figure 1:
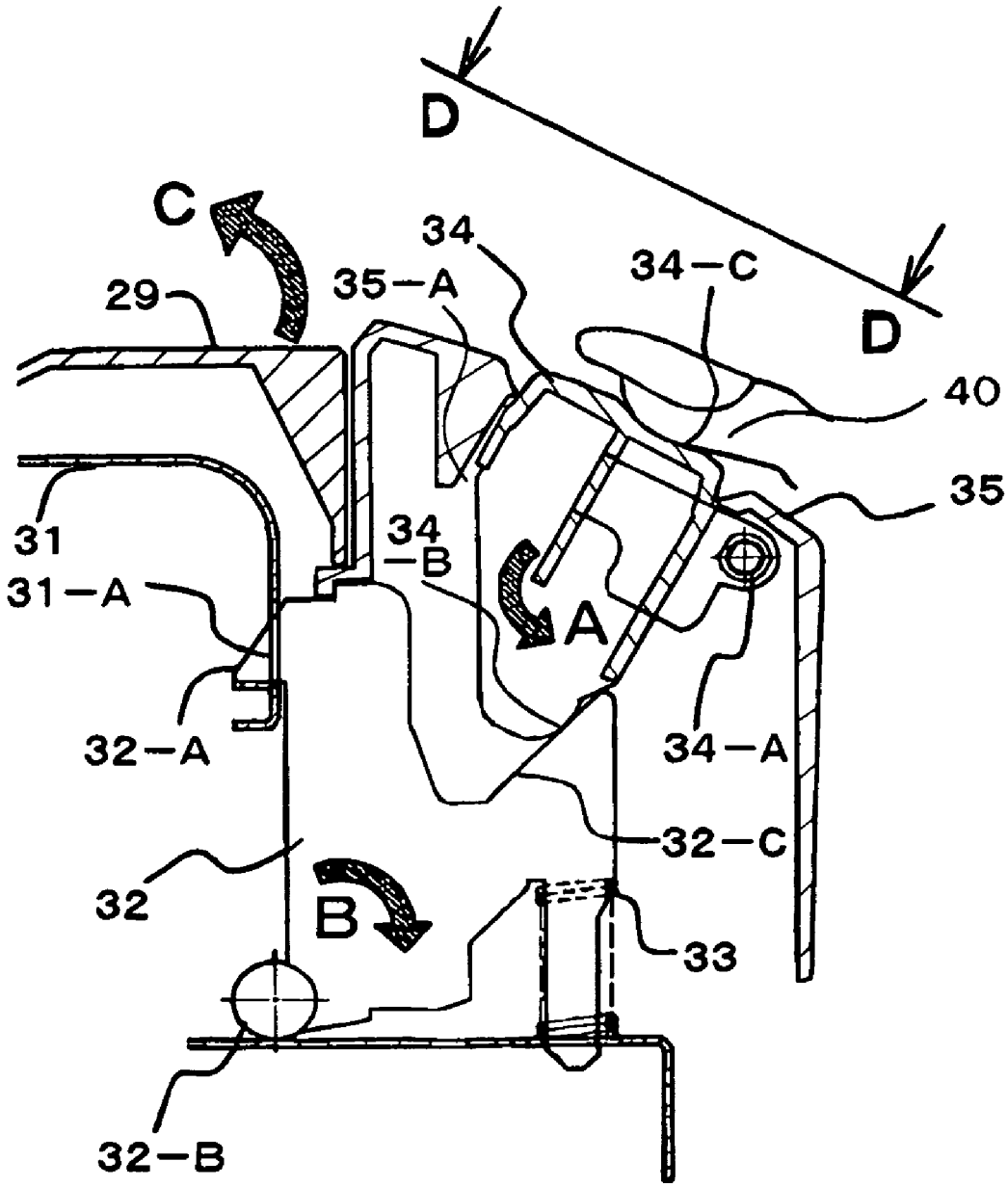
FIG. 1 is a schematic sectional view showing a pushbutton mechanism in a state that a top cover is closed according to a first embodiment of the present invention.
Figure 4:
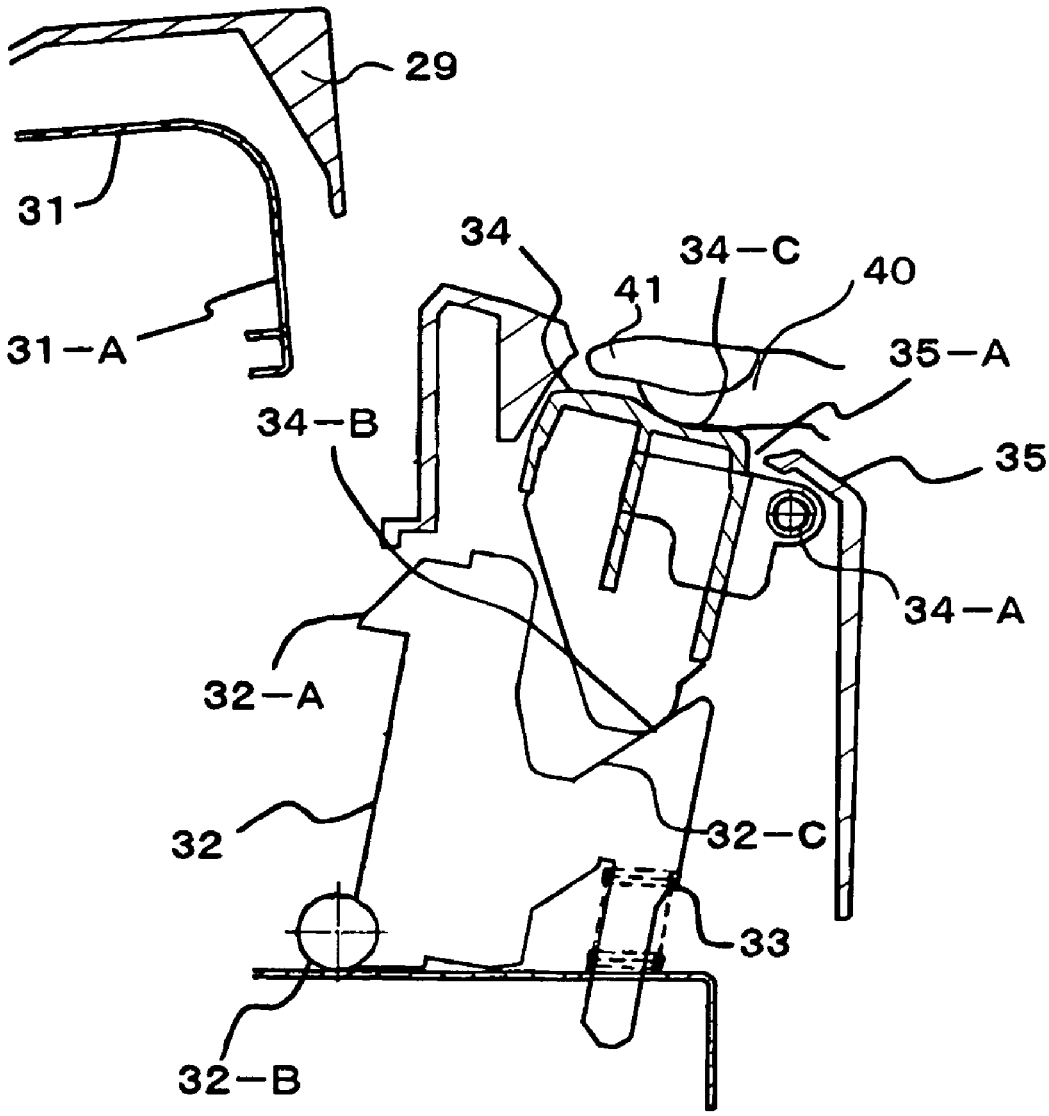
FIG. 4 is a schematic sectional view showing the pushbutton mechanism in a state that the top cover is opened according to the first embodiment of the present invention.

A configuration of a pushbutton mechanism will be explained next. FIG. 1 is a schematic sectional view showing the pushbutton mechanism in a state that the top cover 29 is closed according to the first embodiment of the present invention. FIG. 4 is a schematic sectional view showing the pushbutton mechanism in a state that the top cover 29 is opened according to the first embodiment of the present invention.

As shown in FIG. 1, an inner plate 31 made of a metal plate is fixed to the top cover 29, and the inner plate 31 is provided with an urging member (not shown) such as a torsion spring at a position of the shaft 30 (refer to FIG. 2), so that the top cover 29 is urged around the shaft 30 in an arrow direction C or a direction that the top cover 29 is opened. Further, the inner plate 31 includes an opening portion 31-A. When the top cover 29 is closed, a claw portion 32-A of a lock lever 32 is inserted into the opening portion 31-A, thereby locking the top cover 29.

In the embodiment, the lock lever 32 is provided with a pivot 32-B, and a spring 33 urges the lock lever 32 toward a direction of locking the opening portion 31-A of the inner plate 31, so that the lock lever 32 engages the top cover 29 in a closed state. The pushbutton 34 for releasing a locked state of the top cover 29 includes a pivot 34-A supported on the front case 35 as a housing, and an operation rib 34-B contacting with an operation surface 32-C of the lock lever 32. An upper surface of the pushbutton 34 is exposed from a front side of the front case 35 through a button hole 35-A formed in the front case 35.

In the embodiment, the pivot 34-A is disposed at a front side of an operation surface of the image forming apparatus 1 with respect to an operator. If the pivot 34-A is disposed at a rear side of the operation surface of the image forming apparatus 1, it is necessary for the operator to push the pushbutton 34 in a direction opposite to a bending direction of a finger of the operator, thereby lowering operational ability.

In the embodiment, when the operator pushes the upper surface of the pushbutton 34 downwardly around the pivot 34-A, the pushbutton 34 moves down inside the front case 35, so that the operation rib 34-B pushes the operation surface 32-C of the lock lever 32 against an urging force of the spring 33. Accordingly, the claw portion 32-A of the lock lever 32 is disengaged from the opening portion 31-A, thereby releasing the top cover 29 (refer to FIG. 4).

In the embodiment, as shown in FIGS. 1 and 3, a curved recess portion 34-C is formed in the upper surface of the pushbutton 34 at the front side of the operation surface of the image forming apparatus 1. The curved recess portion 34-C is formed in a curved shape for fitting a finger 40 of the operator. Preferably, the curved recess portion 34-C is formed in a symmetric shape with respect to a right-left direction thereof.

In the embodiment, the pushbutton 34 is disposed on the front case 35 to form a part of the housing of the image forming apparatus 1, so that the upper surface of the pushbutton 34 is flash with the upper surface of the front case 35. It is preferred that the upper surface of the pushbutton 34 does not protrude from the upper surface of the front case 35 to a large extent, thereby preventing the pushbutton 34 from being inadvertently pushed by the operator.

An operation of the pushbutton mechanism will be explained next. In the image forming apparatus 1, when a consumable component such as the image forming units 2K, 2Y, 2M, and 2C, the transfer unit 27, and the fixing unit 28 is replaced, or a print medium jam occurs during a printing operation, the operator opens the top cover 29.

First, as shown in FIG. 1, the operator places the finger 40 on the curved recess portion 34-C of the pushbutton 34 to push the pushbutton 34 downwardly. Accordingly, the pushbutton 34 moves downwardly around the pivot 34-A, so that the operation rib 34-B pushes the operation surface 32-C of the lock lever 32 against the urging force of the spring 33. Further, the pushbutton 34 rotates and moves down inside the front case 35 in an arrow direction A through the button hole 35-A of the front case 35.

At this moment, the lock lever 32 rotates around the pivot 32-B in an arrow direction B, so that the claw portion 32-A is disengaged from the opening portion 31-A of the inner plate 31. Accordingly, the inner plate 31 is opened in the arrow direction C with ah urging force of the urging member (not shown) such as a torsion spring (refer to FIG. 4).

In the embodiment, as shown in FIG. 4, the curved recess portion 34-C is formed in the upper surface of the pushbutton 34 at the front side of the operation surface of the image forming apparatus 1. Accordingly, when the operator opens the top cover 29, the finger 40 is placed on the curved recess portion 34-C. As a result, when the pushbutton 34 moves inside the front case 35 through the button hole 35-A, it is possible to prevent a nail 41 (especially a long nail) from being caught with an edge of the button hole 35-A of the front case 35. In other word, the curved recess portion 34-C functions as a guide member for guiding the finger 40 of the operator, so that the finger 40 is placed at the front side of the operation surface.

As described above, in the embodiment, the curved recess portion 34-C is formed in the upper surface of the pushbutton 34 at the front side of the operation surface with respect to the operator. Accordingly, it is possible to prevent the nail 41 (especially a long nail) from being caught with the edge of the button hole 35-A of the front case 35.

Second Embodiment

A second embodiment of the invention will be described below with reference to FIGS. 2, 5, 6, and 7. Components in the second embodiment similar to those in the first embodiment are designated by the same reference numerals, and explanations thereof are omitted.

Figure 5:
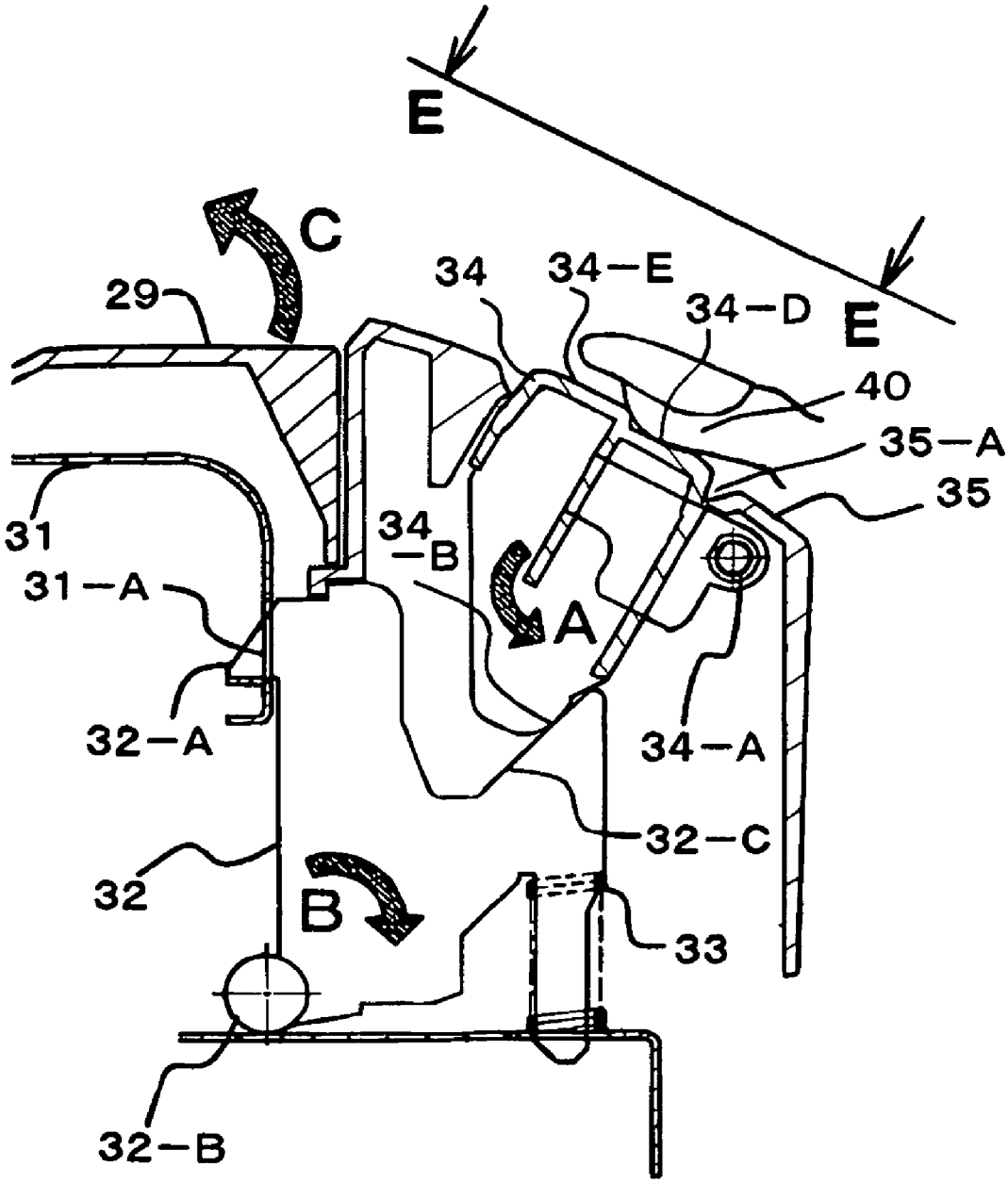
FIG. 5 is a schematic sectional view showing a pushbutton mechanism in a state that a top cover is closed according to a second embodiment of the present invention.
Figure 6:
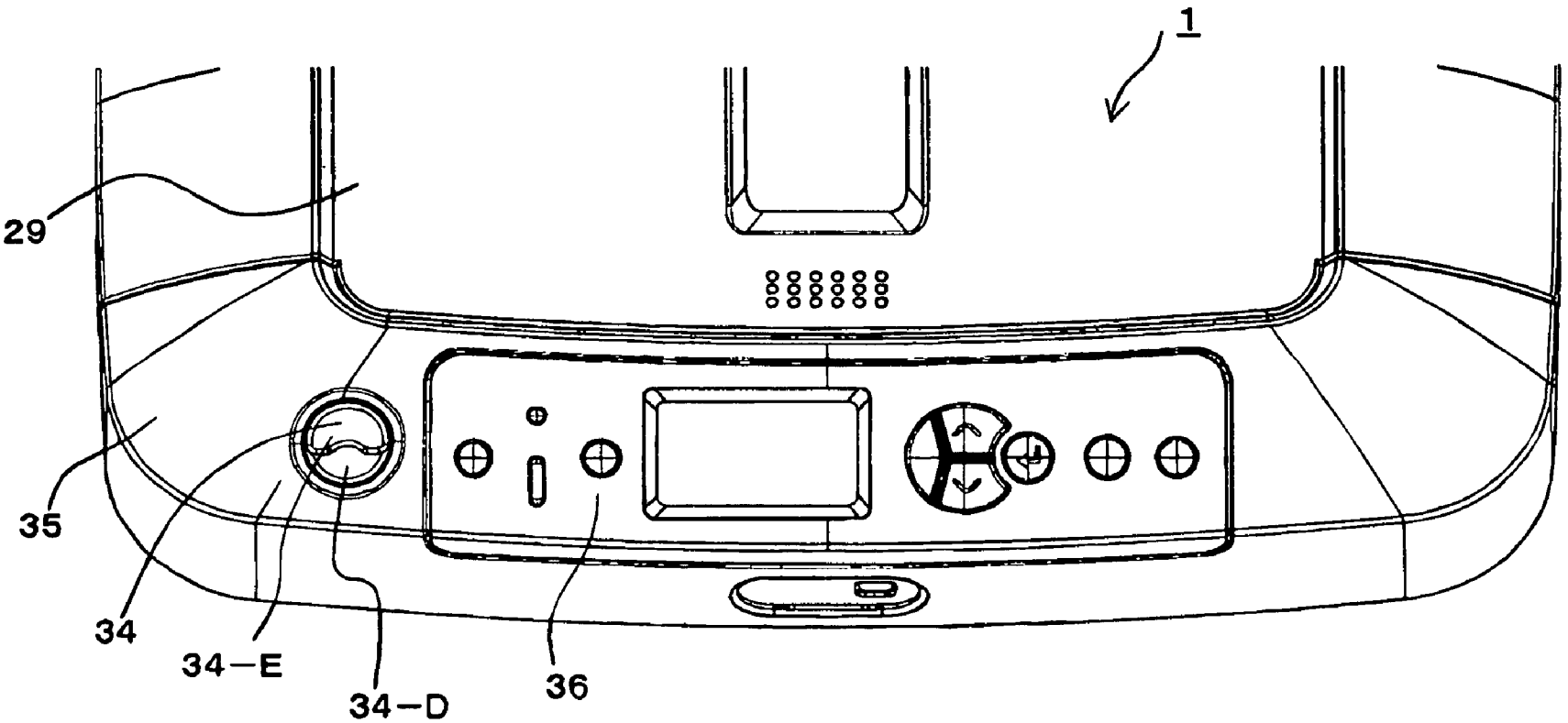
FIG. 6 is a schematic plan view showing an operation panel of an image forming apparatus according to the second embodiment of the present invention.
Figure 7:
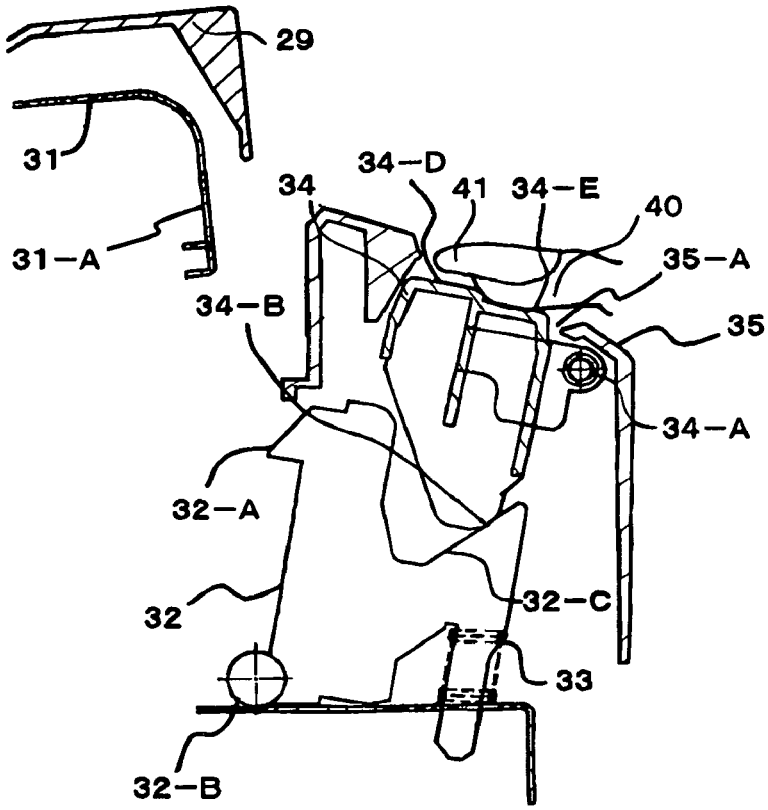
FIG. 7 is a schematic sectional view showing the pushbutton mechanism in a state that the top cover is opened according to the second embodiment of the present invention.

FIG. 5 is a schematic sectional view showing a pushbutton mechanism in a state that the top cover 29 is closed according to the second embodiment of the present invention. FIG. 6 is a schematic plan view showing the operation panel 36 of the image forming apparatus 1 according to the second embodiment of the present invention. FIG. 7 is a schematic sectional view showing the pushbutton mechanism in a state that the top cover 29 is opened according to the second embodiment of the present invention.

As shown in FIG. 6, in the image forming apparatus 1, similar to the first embodiment, the pushbutton 34 of the top cover 29 is disposed adjacent to the operation panel 36 for opening and closing the top cover 29.

In the embodiment, a step recess portion 34-D is formed in the upper surface of the pushbutton 34 at the front side of the operation surface of the image forming apparatus 1, and a step protruded portion 34-E is formed in the upper surface of the pushbutton 34 at the rear side of the operation surface of the image forming apparatus 1. The step recess portion 34-D is formed adjacent to the step protruded portion 34-E with a boundary in between. The boundary has a curved shape curved toward the step protruded portion 34-E for fitting the finger 40 of the operation, and may have a linear shape.

An operation of the pushbutton mechanism will be explained next. In the image forming apparatus 1, when the consumable component such as the image forming units 2K, 2Y, 2M, and 2C, the transfer unit 27, and the fixing unit 28 is replaced, or the print medium jam occurs during the printing operation, the operator opens the top cover 29.

First, as shown in FIG. 5, the operator places the finger 40 on the step recess portion 34-D of the pushbutton 34 to push the pushbutton 34 downwardly. Accordingly, the pushbutton 34 moves downwardly around the pivot 34-A, so that the operation rib 34-B pushes the operation surface 32-C of the lock lever 32 against the urging force of the spring 33. Further, the pushbutton 34 rotates and moves down inside the front case 35 in the arrow direction A through the button hole 35-A of the front case 35. The rest of the operation is similar to that in the first embodiment.

In the embodiment, as shown in FIGS. 5 and 7, the step protruded portion 34-E is formed in the upper surface of the pushbutton 34 at the rear side of the operation surface of the image forming apparatus 1. Accordingly, when the operator opens the top cover 29, the finger 40 abuts against the step protruded portion 34-E and does not move beyond the step protruded portion 34-E. As a result, when the pushbutton 34 moves inside the front case 35 through the button hole 35-A, it is possible to prevent the nail 41 (especially a long nail) from being caught with the edge of the button hole 35-A of the front case 35.

As described above, in the embodiment, the step protruded portion 34-E is formed in the upper surface of the pushbutton 34 at the rear side of the operation surface with respect to the operator. Accordingly, the finger 40 abuts against the step protruded portion 34-E, so that it is possible to prevent the nail 41 (especially a long nail) from being caught with the edge of the button hole 35-A of the front case 35.

Third Embodiment

A third embodiment of the invention will be described below with reference to FIG. 8. Components in the third embodiment similar to those in the first and second embodiments are designated by the same reference numerals, and explanations thereof are omitted.

Figure 8:
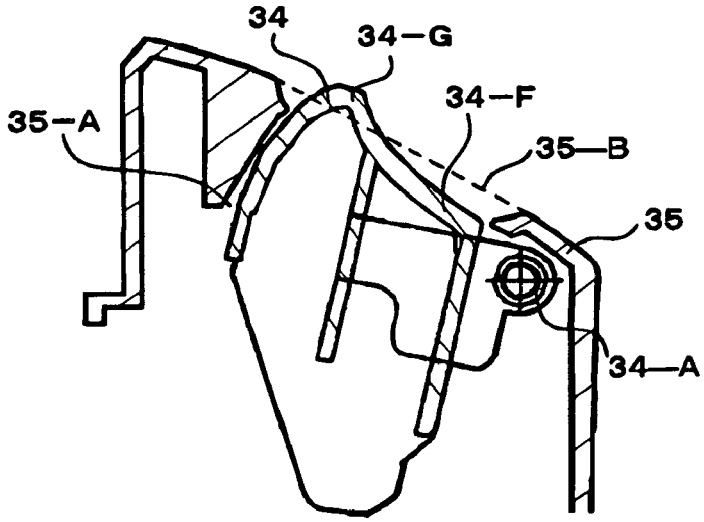
FIG. 8 is a schematic sectional view showing a pushbutton mechanism according to a third embodiment of the present invention.

FIG. 8 is a schematic sectional view showing a pushbutton mechanism according to the third embodiment of the present invention. As shown in FIG. 8, the upper surface of the pushbutton 34 is inclined upwardly from the front side of the operation surface (a right side in FIG. 8) toward the rear side (a left side in FIG. 8).

More specifically, with respect to an upper surface 35-B of the front case 35, the pushbutton 34 includes a valley portion 34-F at the front side of the operation surface and a mountain portion 34-G at the rear side of the operation surface. The valley portion 34-F is recessed relative to the upper surface 35-B in a direction that the pushbutton 34 is pushed down. The mountain portion 34-G protrudes relative to the upper surface 35-B in a direction opposite to the direction that the pushbutton 34 is pushed down. The valley portion 34-F is formed adjacent to the mountain portion 34-G with a boundary in between, and the boundary is curved upwardly.

In the embodiment, when the operator places the finger 40 on the valley portion 34-F of the pushbutton 34, the finger 40 abuts against the mountain portion 34-G. Accordingly, it is possible to prevent the nail 41 (especially a long nail) from being caught with the edge of the button hole 35-A of the front case 35.

Fourth Embodiment

A fourth embodiment of the invention will be described below with reference to FIGS. 9(*a*) and 9(*b*). Components in the fourth embodiment similar to those in the first to third embodiments are designated by the same reference numerals, and explanations thereof are omitted.

Figure 9A:
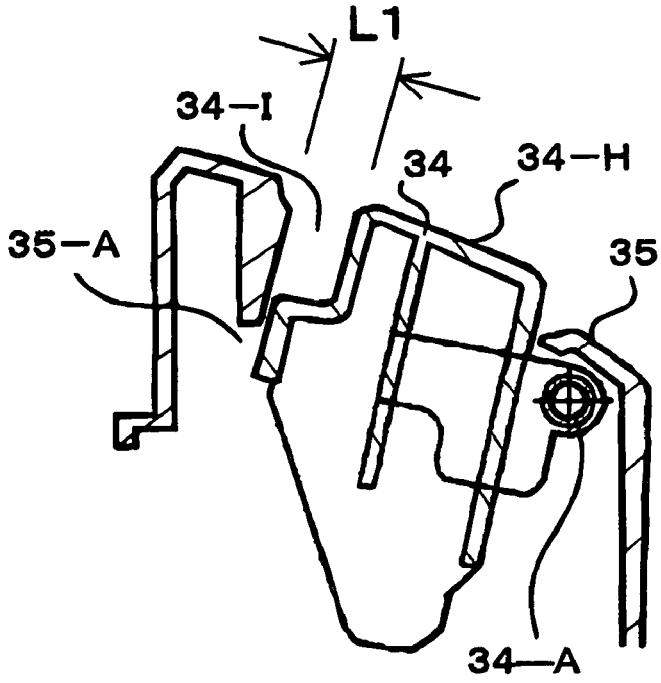
FIGS. 9(*a*) and 9(*b*) are schematic views showing a pushbutton mechanism according to a fourth embodiment of the present invention, wherein FIG. 9(*a*) is a schematic sectional view showing the pushbutton mechanism, and FIG. 9(*b*) is a schematic plan view of a pushbutton.
Figure 9B:
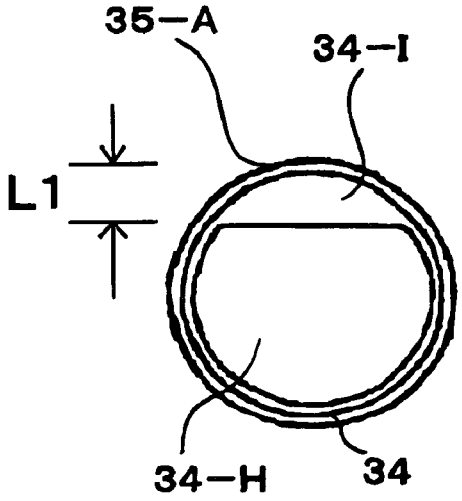

FIGS. 9(*a*) and 9(*b*) are schematic views showing a pushbutton mechanism according to the fourth embodiment of the present invention. More specifically, FIG. 9(*a*) is a schematic sectional view showing the pushbutton mechanism, and FIG. 9(*b*) is a schematic plan view of a pushbutton.

As shown in FIG. 9(*a*), a cut portion 34-I is formed in the upper surface of the pushbutton 34 at the rear side of the operation surface. The cut portion 34-I has a width smaller than the finger 40 of the operation, so that the finger 40 does not enter the cut portion 34-I.

More specifically, with respect to the upper surface 35-B of the front case 35, the pushbutton 34 includes a flat upper surface at the front side of the operation surface and the cut portion 34-I at the rear side of the operation surface.

As shown in FIG. 9(*b*), the pushbutton 34 has an upper surface 34-H having a circular shape larger than a half circle. The cut portion 34-I forms a distance L1 relative to the button hole 35-A, and the distance L1 is defined such that the finger 40 does not enter the cut portion 34-I. Accordingly, when the operator places the finger 40 on the upper surface 34-H of the pushbutton 34, the finger 40 does not enter the cut portion 34-I.

Fifth Embodiment

A fifth embodiment of the invention will be described below with reference to FIGS. 10(*a*) and 10(*b*). Components in the fifth embodiment similar to those in the first to fourth embodiments are designated by the same reference numerals, and explanations thereof are omitted.

Figure 10A:
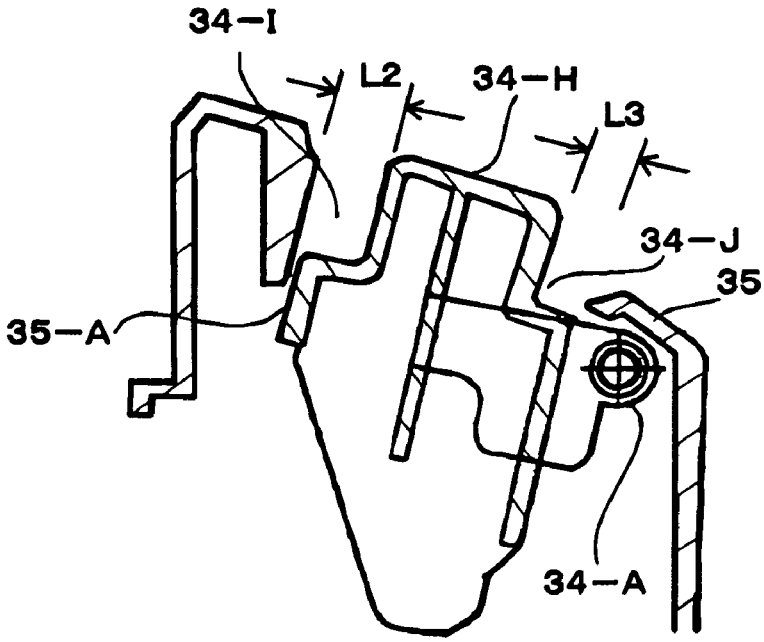
FIGS. 10(*a*) and 10(*b*) are schematic views showing a pushbutton mechanism according to a fifth embodiment of the present invention, wherein FIG. 10(*a*) is a schematic sectional view of the pushbutton mechanism, and FIG. 10(*b*) is a schematic plan view of a pushbutton.
Figure 10B:
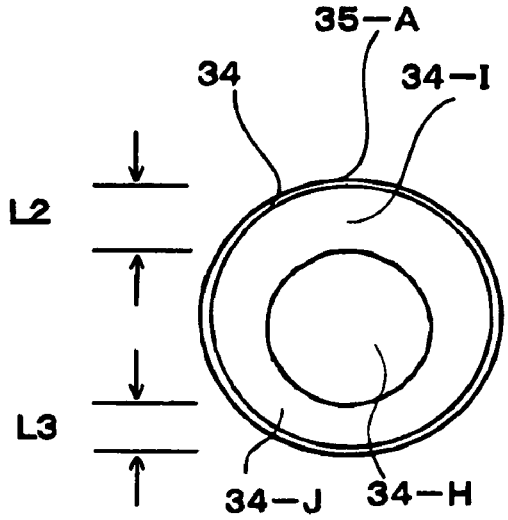

FIGS. 10(*a*) and 10(*b*) are schematic views showing a pushbutton mechanism according to the fifth embodiment of the present invention. More specifically, FIG. 10(*a*) is a schematic sectional view of the pushbutton mechanism, and FIG. 10(*b*) is a schematic plan view of a pushbutton.

As shown in FIG. 10(*a*), the cut portion 34-I and a cut portion 34-J are formed around the upper surface 34-H of the pushbutton 34. The cut portion 34-I and the cut portion 34-J have widths smaller than the finger 40 of the operation, so that the finger 40 does not enter the cut portion 34-I and the cut portion 34-J.

As shown in FIG. 10(*b*), the pushbutton 34 includes the flat upper surface 34-H, and the cut portion 34-I and the cut portion 34-J around a whole circumference of the upper surface 34-H. Accordingly, the upper surface 34-H has an island shape.

In the embodiment, the cut portion 34-I forms a distance L2 relative to the button hole 35-A at the rear side of the operation surface, and the cut portion 34-J forms a distance L3 relative to the button hole 35-A at the front side of the operation surface. It is preferred that the distance L2 is greater than the distance L3. Accordingly, when the operator places the finger 40 on the upper surface 34-H of the pushbutton 34, the finger 40 does not enter the cut portion 34-I and the cut portion 34-J.

In the embodiments described above, when the operator opens the top cover 29 of the image forming apparatus 1, the pushbutton 34 rotates around the pivot 34-A, and it may be configured such that the pushbutton 34 moves vertically relative to the front case 35. Further, the pushbutton mechanism is disposed in the upper surface of the image forming apparatus 1, and may be disposed in a side surface or a front surface of the image forming apparatus 1.

The disclosure of Japanese Patent Application No. 2007-336034, filed on Dec. 27, 2007, is incorporated in the application.

While the invention has been explained with reference to the specific embodiments of the invention, the explanation is illustrative and the invention is limited only by the appended claims.

What is claimed is:

1. An image forming apparatus comprising, a case member having of an operation surface with a button hole;

a cover disposed to be opened or closed relative to the case member;

a pushbutton having an upper surface to be pushed in a pushing direction, said pushbutton including a first rotational shaft on a front side of the operation surface, said upper surface including a first portion at the front side of the operation surface and a second portion at a rear side of the operation surface with respect to an operator, said first portion being formed in a first shape, said second portion being formed in a second shape different from the first shape; and a lock lever having a second rotational shaft, a first engaging portion for engaging a bottom portion of the pushbutton, and a second engaging portion for engaging the cover when the cover is closed; said lock lever being arranged inside the case member to be rotatable around the second rotational shaft, wherein said pushbutton is arranged to rotate around the first rotational shaft in a first direction and the bottom portion of the pushbutton pushes the first engaging portion in a specific direction when the pushbutton is pushed so that the lock lever rotates around the second rotational shaft in a second direction, opposite to the first direction, to disengage the cover from the second engaging portion.

2. The image forming apparatus according to claim 1, wherein said first portion is formed in a recessed shape.

3. The image forming apparatus according to claim 1, wherein said second portion is formed in a protruded shape.

4. The image forming apparatus according to claim 1, wherein said second portion is formed in the protruded shape gradually inclined from one side toward the end of the first portion, said second portion protruding from the operation surface.

5. The image forming apparatus according to claim 1, wherein said first portion is recessed from the operation surface.

6. The image forming apparatus according to claim 1, wherein said second portion is formed of a cut portion.

7. The image forming apparatus according to claim 1, wherein said second portion is formed of a protruded portion with an island shape, said first portion being formed of a cut portion adjacent to the protruded portion.

8. The image forming apparatus according to claim 1, wherein said pushbutton is arranged so that the upper surface is substantially flush with the operation surface when the pushbutton is not pushed.

9. The image forming apparatus according to claim 1, wherein said first rotational shaft is arranged to face the second rotational shaft with the first engaging portion in between.

10. The image forming apparatus according to claim 1, wherein said first portion is formed in a curved shape matching a fingertip of the operator.

11. The image forming apparatus according to claim 1, wherein said first portion is arranged adjacent to the second portion with a boundary portion with a curved shape in between.

* * * * *